US005287872A

United States Patent [19]

Anderson

[11] Patent Number: 5,287,872

[45] Date of Patent: Feb. 22, 1994

[54] PORTABLE UMBRELLA SHELTER

[76] Inventor: Dennis L. Anderson, 2544 N. 7th St., Phoenix, Ariz. 85006

[21] Appl. No.: 922,820

[22] Filed: Sep. 28, 1992

Related U.S. Application Data

[60] Continuation-in-part of Ser. No. 678,662, Apr. 1, 1991, Pat. No. 5,135,018, which is a division of Ser. No. 405,200, Sep. 11, 1989, abandoned.

[51] Int. Cl.[5] ..... E04H 15/28

[52] U.S. Cl. ..... 135/98; 135/20.1; 135/900; 248/229

[58] Field of Search ..... 135/98, 20.1, 25.1, 135/33.1, 900; 248/231.7, 229

[56] References Cited

U.S. PATENT DOCUMENTS

| | | | |
|---|---|---|---|
| 48,308 | 6/1865 | Price | 135/25.1 |
| 144,792 | 11/1873 | Prentiss | 135/98 |
| 685,968 | 11/1901 | Brown | 135/33.1 |
| 907,231 | 12/1908 | Hayden | 135/25.1 |
| 988,400 | 4/1911 | Stonebridge | 135/20.1 |
| 1,219,905 | 3/1917 | Barringer | 135/20.1 |
| 2,221,366 | 11/1940 | Bisbing | 135/98 |
| 2,530,765 | 11/1950 | Greenup | 135/25.1 |
| 3,052,251 | 9/1962 | De Jean | 135/900 |
| 3,151,621 | 10/1964 | Jackson | 135/20.1 |
| 4,086,931 | 5/1978 | Hall | 135/20.1 |

FOREIGN PATENT DOCUMENTS

| | | | |
|---|---|---|---|
| 632515 | 8/1934 | Fed. Rep. of Germany | 248/231.7 |
| 2420916 | 11/1975 | Fed. Rep. of Germany | 135/20.1 |
| 231590 | 7/1893 | France | 135/25.1 |
| 865334 | 5/1941 | France | 135/25.1 |
| 177421 | 3/1922 | United Kingdom | 135/25.1 |
| 627698 | 8/1949 | United Kingdom | 135/20.1 |

*Primary Examiner*—Henry E. Raduazo

*Attorney, Agent, or Firm*—Don J. Flickinger; Jordan M. Meschkow; Robert A. Parsons

[57] ABSTRACT

A portable collapsible shelter for use at sporting events and the like includes a flexible enclosure having a viewing window in one wall thereof. The enclosure is supported by a frame which includes a vertical support pole and a plurality of ribs hinged for movement from a collapsed position alongside the pole to an extended position nearly perpendicular to the pole. The enclosure is left in place over frame when the ribs are collapsed, and folded into a compact storage packet which is secured with a fastening band.

2 Claims, 4 Drawing Sheets

FIG. 1
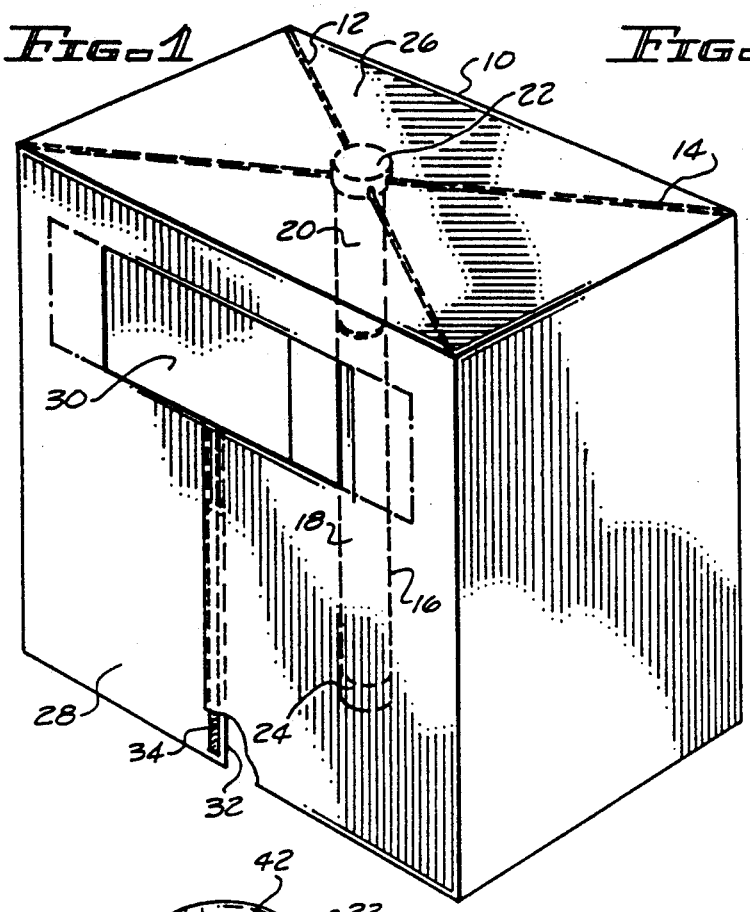
FIG. 2
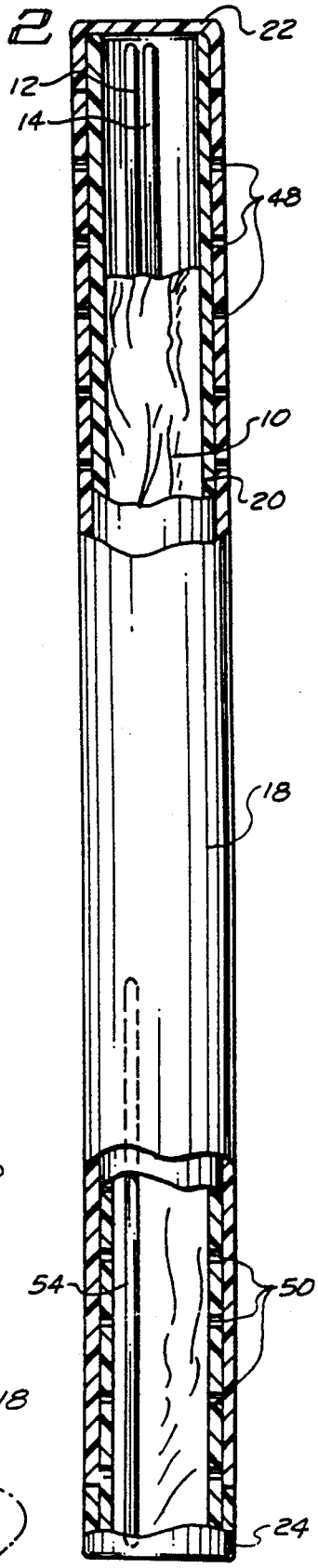
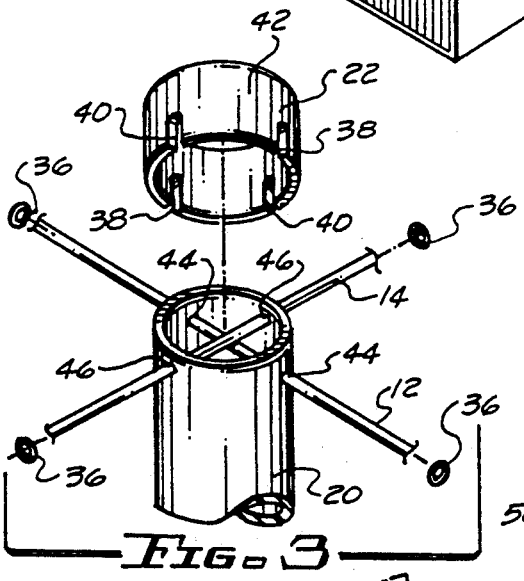
FIG. 3
FIG. 4
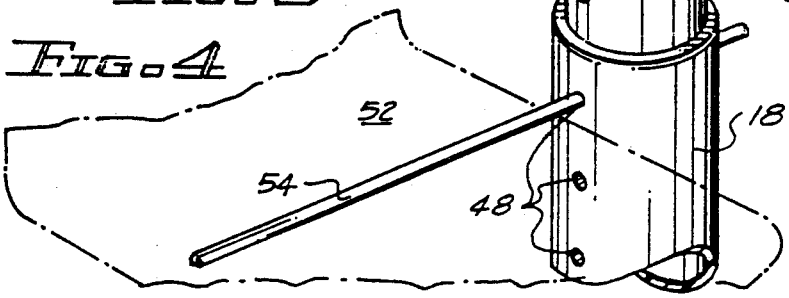

FIG. 5
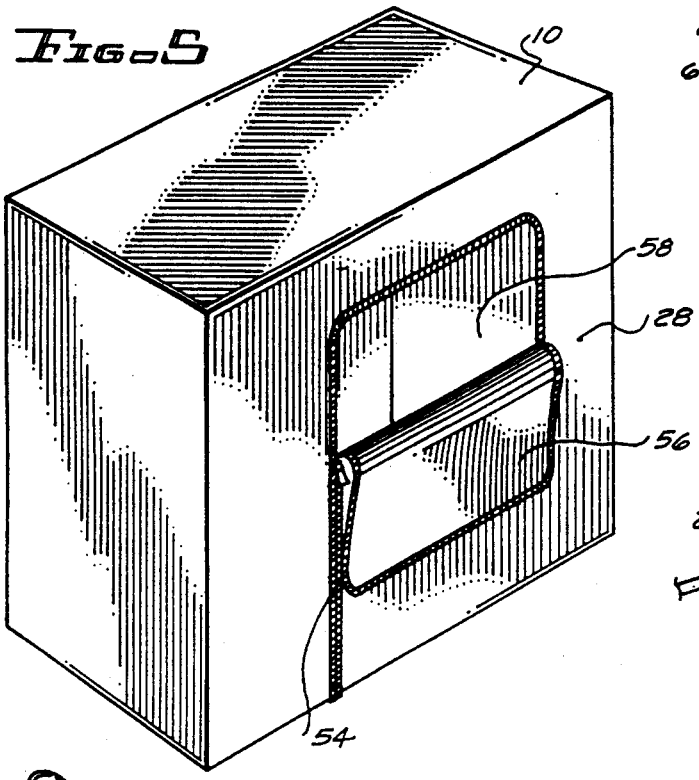
FIG. 7
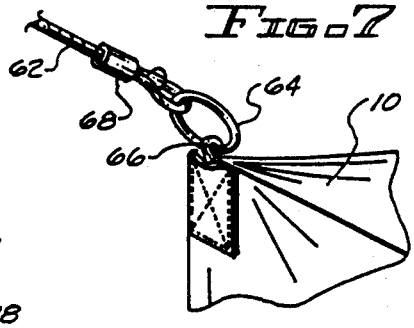
FIG. 8
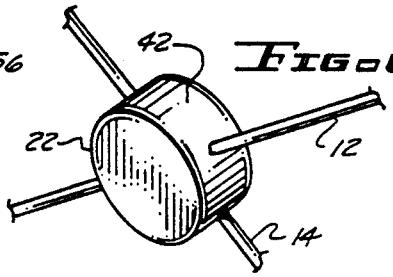
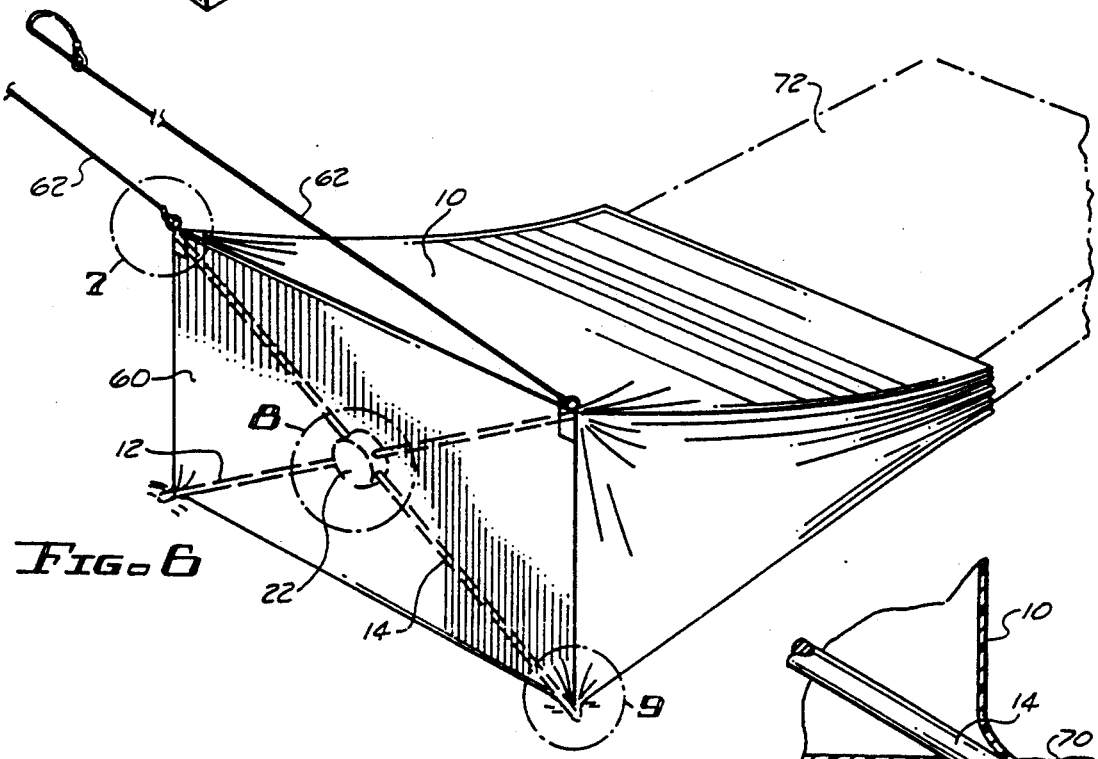
FIG. 6
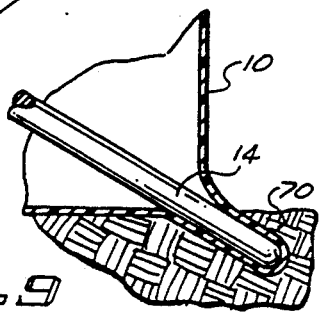
FIG. 9

FIG. 10
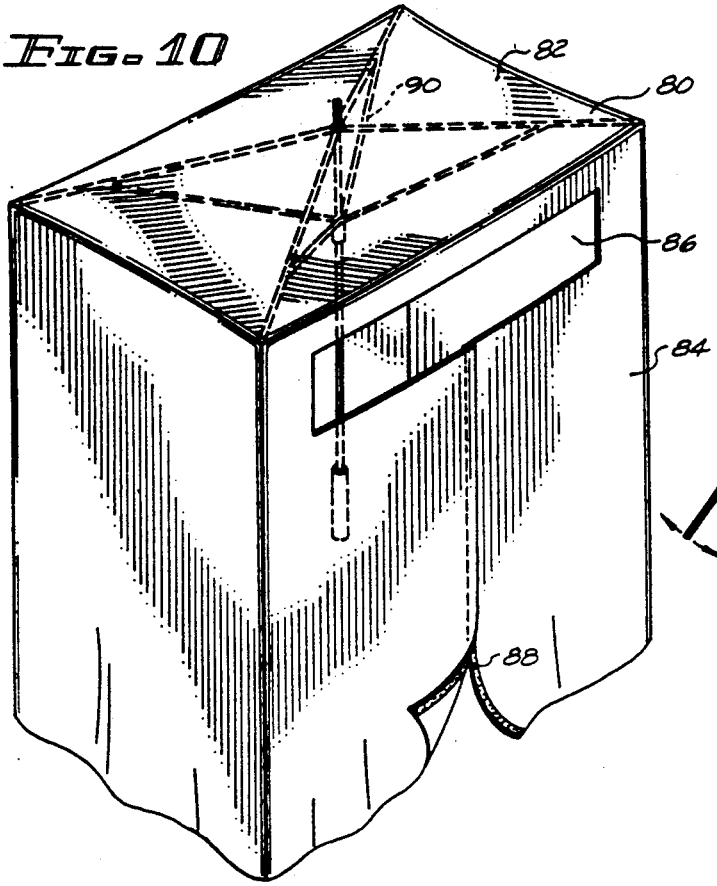
FIG. 11
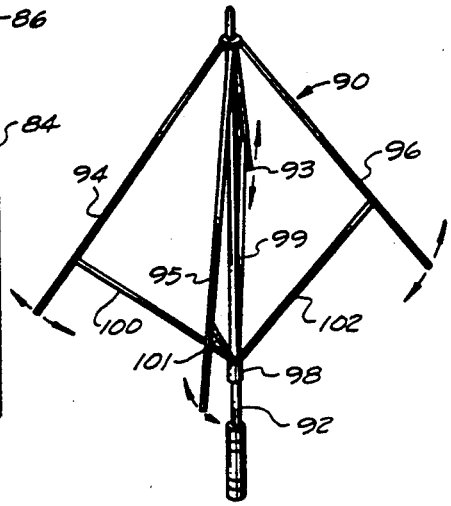
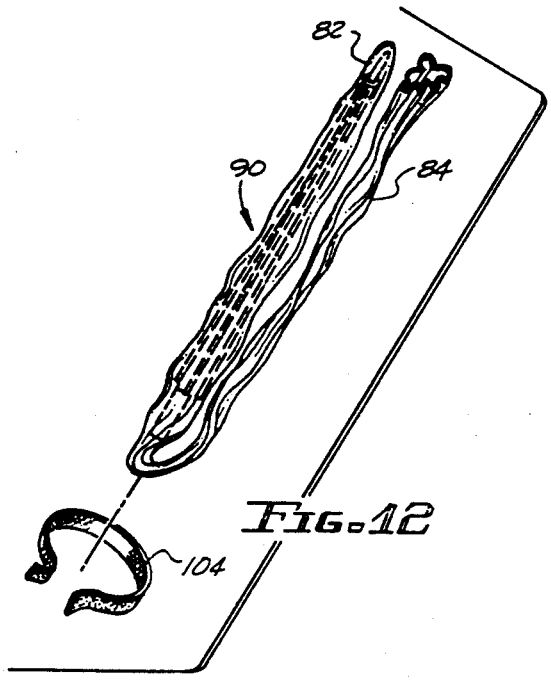
FIG. 12
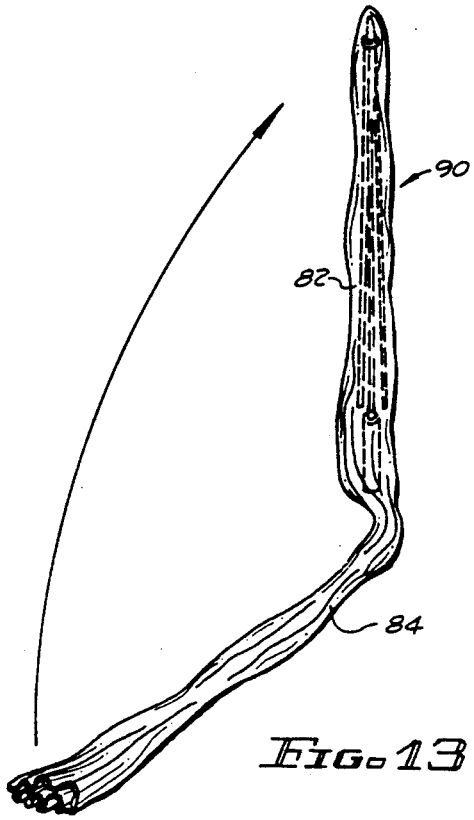
FIG. 13

FIG. 14
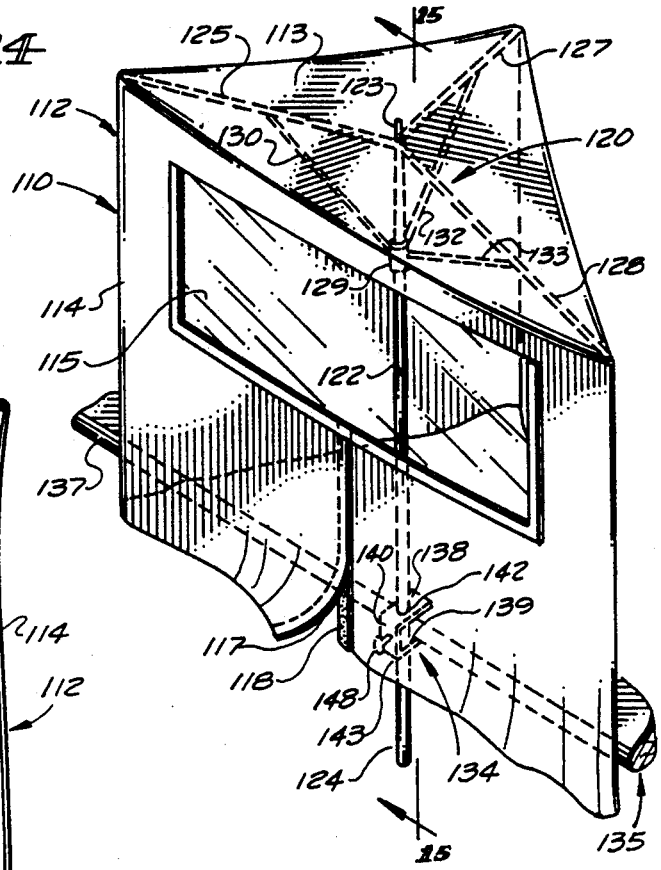
FIG. 15
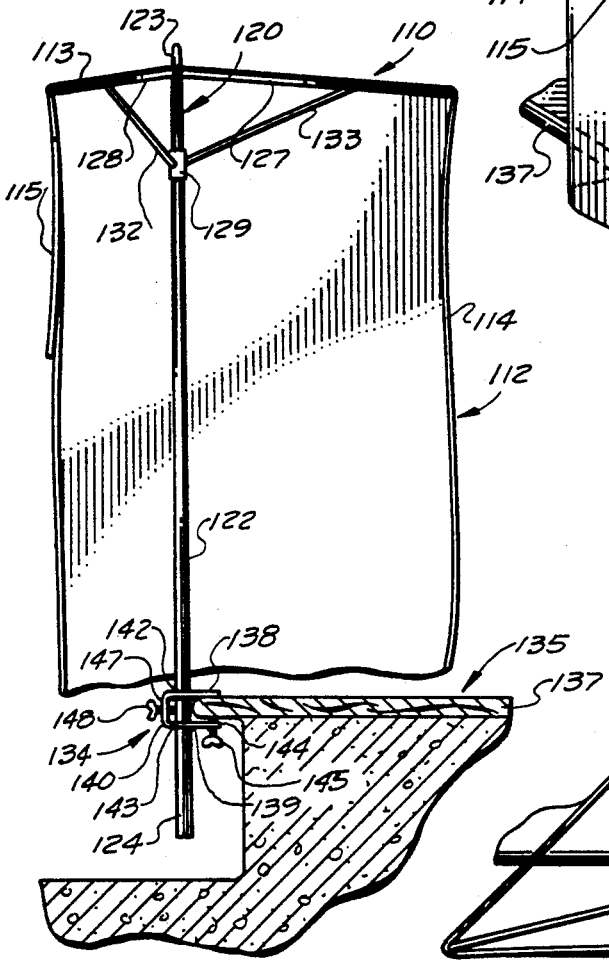
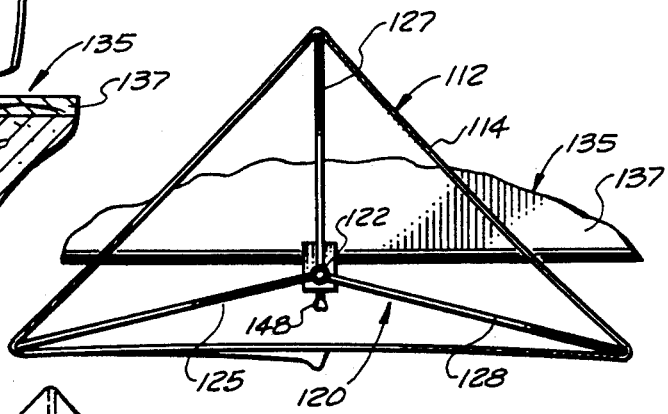
FIG. 16
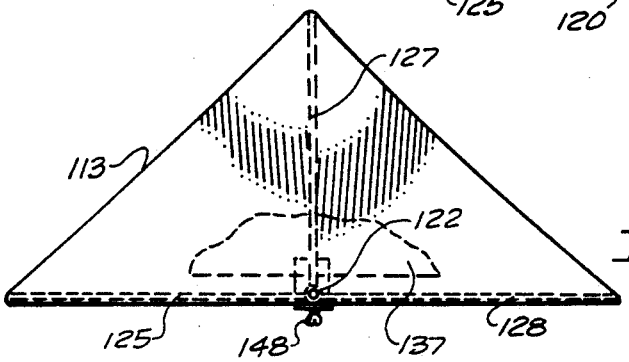
FIG. 17

PORTABLE UMBRELLA SHELTER

CROSS-REFERENCE TO RELATED APPLICATION

This application is a Continuation-In-Part of prior application Ser. No. 07/678,662 filed Apr. 1, 1991 and now U.S. Pat. No. 5,135,018 which in turn is a Divisional of prior application Ser. No. 07/405,200 filed Sep. 11, 1989, now abandoned.

BACKGROUND OF THE INVENTION

1. Field of the Invention

This invention relates generally to portable shelters and, more particularly, to a collapsible shelter for use in a stadium or other outdoor scenario to protect its user or users from inclement weather.

2. Prior Art

Often, spectators at sporting events or other outdoor events are forced to leave their seats from which they can view the event in order to find shelter from rain or the like. Conventional umbrellas, due to their size and shape are not suited for high density seating such as that found in stadiums nor do they afford very much protection.

As a result of these disadvantages, collapsible shelters have been proposed. For example, see U.S. Pat. No. 4,086,931 issued May 2, 1978 and entitled UMBRELLA SHELTER; U.S. Pat. No. 2,024,105 issued Dec. 10, 1935 and entitled UMBRELLA; U.S. Pat. No. 2,863,467 issued Dec. 9, 1958 and entitled COMBINATIONAL SHELTERS; and U.S. Pat. No. 734,311 issued Jul. 21, 1903 and entitled ATTACHMENT FOR UMBRELLAS.

U.S. Pat. No. 4,086,931 describes an umbrella shelter which includes a rectangular umbrella which has its supporting pole positioned on the middle of the back edge so as not to obstruct the space under the umbrella. A vertical sheet of fabric hangs down from the back edge and portions of the side edges of the umbrella. This partial enclosure is completed by a removable front panel having a transparent upper portion and attachment means for connection with the umbrella and forward side edges of the vertical back fabric. The umbrella pole may be mounted on a stadium bench for sports spectators, on a seat for fisherman or duck hunters, etc. Unfortunately, this umbrella shelter, like other prior art arrangements, is not easy to transport or store.

SUMMARY OF THE INVENTION

It is an object of the present invention to provide an improved portable shelter.

It is a further object of the present invention to provide an improved collapsible shelter.

It is a still further object of the present invention to provide an improved collapsible shelter wherein the supporting pole is also a container for the remainder of the shelter when being stored or otherwise not in use.

Yet another object of the present invention is to provide an improved umbrella-type shelter wherein the length of the supporting pole or handle is adjustable to accommodate a user which is standing or sitting.

It is another object of the present invention to provide a portable shelter for use on stadium benches.

It is yet another object of the present invention to provide a portable shelter which can be attached to a bench.

It is still another object of the present invention to provide a portable shelter which can be attached to a seat and be adjusted for height.

It is yet still another object of the present invention to provide a portable shelter which completely encircles and covers a user, while being easily entered.

And another object the present invention is to provide a portable shelter simple to set-up and take down.

Accordingly, in a first embodiment of the invention there is provided a portable collapsible shelter comprised of a flexible material having a top and at least one sidewall depending therefrom, at least one frame member for engaging and supporting the top, and a hollow pole member for coupling to and supporting the frame member, the hollow pole member for receiving and storing the flexible material and the frame member when the shelter is being transported or otherwise not in use.

The hollow pole member may be telescopic to vary the height of the shelter, and the top may be rectangular to accommodate stadium type seating. Four side walls may be provided to provide a protective enclosure, and a viewing window may be provided in one of the walls.

Caps are provided at both ends of the hollow pole member to form an enclosure for the folded up flexible material and disassembled frame during transport and storage.

In an alternate embodiment of the invention, the shelter comprises a flexible material supported on a conventional umbrella-type frame consisting of a vertical support pole, a plurality of ribs each hinged to one end of the pole, a slide ring carried on the support pole for opening and closing the shelter, and a plurality of strut links connected between the slide ring and the ribs. When the frame is collapsed to a non--use position, the flexible material may be left in place on the frame and doubled over to form a compact storage packet. Fastening means may be provided for securing the flexible material in its folded configuration.

BRIEF DESCRIPTION OF THE DRAWINGS

The foregoing and further and more specific objects and advantages of the instant invention will become readily apparent to those skilled in the art from the following detailed description of preferred embodiments thereof in which:

FIG. 1 is a perspective view of the inventive portable shelter;

FIG. 2 illustrates how the entire shelter of FIG. 1 is stored within the supporting pole or handle;

FIG. 3 illustrates how the crossbars of the FIG. 1 shelter pass through openings in an upper portion of the support pole or handle and how the resulting portion is capped;

FIG. 4 illustrates the telescoping support pole or handle of the shelter shown in FIG. 1;

FIG. 5 illustrates an alternate embodiment of the inventive portable shelter;

FIG. 6 illustrates yet an additional embodiment of the present invention;

FIG. 7 illustrates the attachment means utilized in the embodiment shown in FIG. 6;

FIG. 8 illustrates an alternate cap in the embodiment shown in FIG. 6;

FIG. 9 illustrates the attachment means utilized in the embodiment shown in FIG. 6;

FIG. 10 is a perspective view showing an alternative embodiment of the portable shelter;

FIG. 11 illustrates the collapsible frame used with the portable shelter of FIG. 9;

FIG. 12 illustrates the portable shelter of FIG. 9 in its folded configuration and in exploded relationship to a fastening band;

FIG. 13 illustrates the portable shelter of FIG. 9 during an intermediate folding step;

FIG. 14 is a perspective view illustrating an alternate embodiment of the portable shelter as it would appear attached to a bench;

FIG. 15 is a cross-sectional side view taken along line 2—2 of FIG. 14;

FIG. 16 is a top view illustrating a first rib configuration;

FIG. 17 is a top view illustrating a second rib configuration.

DESCRIPTION OF THE PREFERRED EMBODIMENT

FIG. 1 illustrates a first embodiment of the inventive collapsible shelter. The shelter comprises an enclosure 10 of flexible material (e.g. plastic, canvas, nylon, etc.) supported by cross-bars 12 and 14 which are in turn supported by a hollow support pole 16. Support pole 16 preferably comprises first and second telescoping members 18 and 20 respectively and is closed at its upper and lower ends by removable caps 22 and 24 respectively.

Enclosure 10 comprises a rectangular top 26 and four sidewalls including a front sidewall 28. As can be seen, front sidewall 28 has a viewing window 30 provided therein and may also include a slit 32 for selectively opening and closing wall 28 to provide entry into and exit from enclosure 10. Slit 32 may be secured by a variety of fastening means; e.g. snaps, zipper, or as shown, a Velcro® strip 34.

Referring to FIG. 3, it can be seen that the upper portion of inner telescoping member 20 is provided with two pairs of aligned holes 44 and 46 through which cross-bars 12 and 14 respectively can pass. The ends of cross-bars 12 and 14 are received by receiving rings 36 which are coupled to the top portion of enclosure 10 at the corners. Cap 22 is provided with first and second pairs of grooves 38 and 40 which capture cross-bars 12 and 14 respectively when cap 22 is placed over the upper end of telescoping member 20. Alternately, grooves 38 and 40 may be replaced with aligned holes as shown in FIG. 8. In this case, it would be necessary to place cap 22 over the end of member 20 prior to insertion of cross-bars 12 and 14.

Telescoping members 18 and 20 are each provided with a plurality of aligned holes 48 and 50 respectively. To adjust the height of the shelter, the lower end of outer telescoping member 18 is placed on a support surface (e.g. stadium seat 52). Inner telescoping member 20 is then lifted out of outer member 18 until a desired height is achieved. When a desired height is reached, a retaining rod 54 is inserted through aligned holes in members 18 and 20 to fix the height of the shelter.

The inventive collapsible shelter is capable of easy storage and transport as shown in FIG. 2. That is, when not in use, the folded flexible enclosure 10, cross-bars 12 and 14 and retaining rod 54 fit within inner telescoping member 20 which has been inserted into outer member 18. Upper and lower caps 22 and 24 respectively complete the cylindrical canister.

Disassembly of the shelter is extremely simple. First, the flexible enclosure 10 is removed followed by removal of cross-bars 12 and 14. Next, retaining rod 54 is removed, and inner member 18 inserted into outer member 18. Cross-bars 12 and 14 and retaining rod 54 are placed inside hollow member 18. Flexible enclosure 10 is folded and likewise placed inside hollow member 18. Cap 22 is then placed over the open end of member 20 and abuts outer member 18 to complete the storage/-transport container. Assembly of the inventive shelter requires a mere reversal of this process.

FIG. 5 illustrates an alternate embodiment of the present invention. In this case, a single zipper 54 provides for entry to and exit from the shelter and also secures a flap 56 which, when open, forms a viewing window 58. Flap 56 may be transparent.

FIG. 6 illustrates how the inventive collapsible shelter may be converted into an outdoor sleeping shelter. In this case, hollow support member 16 is dispensed with, and the flexible enclosure 10 is positioned on its side (i.e. horizontally). What was top 26 now becomes a generally vertical sidewall 60 which is urged into its rectangular shape by cap 22 and cross-bars 12 and 14 as previously described.

The upper corners of wall 60 are secured to a nearby structure or trees (not shown) by means of lines 62. That is, a ring 64 is secured to a loop 66 at each of the upper corners of wall 60 as is shown in FIG. 7. A fastener 86 attached to line 62 is then coupled to ring 64.

The lower ends of cross bars 12 and 14 and the adjacent flexible material are forced into the ground 70 as is shown in FIG. 9. With wall 60 secured, one end of an air mattress and/or sleeping bag 72 may be inserted into the shelter as shown in FIG. 6. Thus there has been proved an improved collapsible shelter which may be used in high density seating environments such as stadiums or in remote areas for camping or the like. The shelter is extremely simple to assemble and disassemble. It is completely self contained and, as such, is easy to transport and store.

In an alternative embodiment encircling and covering of the invention, illustrated in FIG. 10, an enclosure 80 a sheltered space 81 is again formed of flexible material and comprises a rectangular top 82 and a sidewall 84, which may consist of four individual walls stitched together at the sides, or a single continuous wall extending entirely around the enclosure. The sidewall 84 includes viewing window 86 and entry slit 88.

Enclosure 80 is supported on a collapsible frame 90, which is best illustrated in FIG. 11. The frame 90 comprises a vertical support pole 92, which may optionally consist of a pair of telescoping members (not shown) to allow the height of enclosure 80 to be varied. Four ribs 93, 94, 95, 96 are hinged to the pole 92 near the top thereof. The free end of each rib supports one of the four corners of rectangular top 82 when the shelter is in use. A slide ring 98 is carried on support pole 92, and four strut links 99, 100, 101, 102 are connected between the slide ring 98 and ribs 93, 94, 95, 96. Like a conventional umbrella, the enclosure 80 is opened by raising slide ring 98, causing strut links 99, 100, 101 and 102 to push ribs 93, 94, 95 and 96 into a nearly horizontal position, and closed by lowering slide ring 98, causing the strut links 99, 100, 101 and 102 to pull ribs 93, 94, 95 and 96 into a collapsed position alongside pole 92.

After slide ring 98 has been lowered and ribs 93, 94, 95 and 96 have been moved into the collapsed position, the sidewall 84 of enclosure 80 hangs loosely below the bottom end of pole 92, as shown in FIG. 13. The bottom edges of the sidewall 84 can then be gathered, and the enclosure 90 doubled upon itself as shown on FIG. 12.

Once folded, the sidewall 84 may be secured against the top 82 by means of fastening band 104, the opposite ends of which are detachably coupled to one another by means of Velcro® or the like. Thus, the collapsed shelter forms a compact, convenient packet which is easy to transport and store.

In a further embodiment of a portable umbrella shelter generally designated 110, illustrated in FIG. 14, an enclosure 112 is formed of flexible material and comprises a triangular top 113 and a side wall 114. Side wall 114 may consist of three individual walls stitched together at the sides, or a single continuous wall extending entirely around the enclosure. Side wall 114 includes viewing window 115 and entry slit 117. Slit 117 may be secured by a variety of fastening devices, such as snaps, zipper, or as shown, a velcro® strip 118.

Enclosure 112 is supported on a collapsible frame 120. Frame 120 comprises a vertical support pole 122 having a top end 123 and a bottom end 124. Three ribs 125, 127, and 128 are hinged to support pole 122 proximate top end 123 thereof. The free end of each of ribs 125, 127, and 128 supports one of the three corners of triangular top 113 when shelter 110 is in use. A slide ring 129 is carried on support pole 122, and three strut links 130, 132, and 133 are connected between slide ring 129 and ribs 125, 127, and 128. Shelter 110 is operated in a matter similar to a conventional umbrella, enclosure 112 is open by raising slide ring 129, causing strut links 130, 132, and 133 to push ribs 125, 127, and 128 into a nearly horizontal position, enclosed by lowering slide ring 129, causing strut links 130, 132, and 133 to pull ribs 125, 127, and 128 into a collapse position along side support pole 122.

Shelter 110 includes an attachment member 134 fastened to support pole 122 proximate bottom end 124, for attaching shelter 110 to a conventional bench 135, such as are found in stadiums, having a horizontal planner panel 137. Attachment member 134 is a substantially C-shaped clamp having an upper prong 138 and a lower prong 139 joined in a parallel spaced apart relationship at one end by a substantially vertical connecting wall 140. Vertical bores 142 and 143 extend through upper prong 138 and lower prong 139 respectively, in alignment, and proximate connecting wall 140. Bores 142 and 143 ar configured to receive bottom end 124 of support pole 122. A set screw bore 144 is formed through lower prong 139 distally from connecting wall 140, configured and threaded to receive a set screw 145. A horizontal bore 147 is formed through connecting wall 140, and is configured and threaded to receive a set screw 148.

In operation, attachment member 134 receives bottom end 124 of support pole 122 through bores 142 and 143. Attachment member 13 is then coupled to bench 135 by positioning attachment member 134 so that panel 137 extends between upper prong 138 and lower prong 139. Attachment member 134 is then held securely in position by threading set screw 145 through bore 144. As can be seen in FIG. 15, set screw 145 and upper prong 138 clamp panel 137 therebetween. Support pole 122 is then secured by tightening set screw 148 in horizontal bore 147, against support pole 122. The height of shelter 110 is easily adjusted by loosening set screw 148, and raising or lowering support pole 122 through bores 142 and 143, then retightening set screw 145.

Referring now to FIG. 16, it can be seen that support pole 122 is positioned generally medially in enclosure 112. This results in enclosure 112 over hanging bench 135. In an alternate rib configuration as illustrated in FIG. 17, support pole 122 is positioned adjacent the front edge of triangular top 113. Ribs 125 and 128 each extend in opposite directions from top end 123 of support pole 122, along the front edge of triangular top 113. Rib 127 extends from top end 123 of support pole 122 rearward, perpendicular to ribs 125 and 128. As can be seen in FIG. 17, this rib configuration shifts enclosure 112 towards the rear of bench 135, substantially eliminating the over hang of enclosure 112 over bench 135.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A portable collapsible shelter, comprising:

a support pole having a first end and a second end;

a first, second, and third rib, each coupled to said support pole proximate said first end, and hinged for movement between a collapsed position alongside said support pole and an extended position substantially perpendicular to said support pole;

an enclosure having a triangular top portion with a first, second and third angle and edges extending therebetween, and a sidewall depending downwardly from said edges, encircling and covering a sheltered space;

said first, second, and third ribs intersect said first, second, and third angles respectively, supporting said enclosure;

said first, second, and third ribs being spaced apart from said edges of said triangular top portion with said support pole position generally centrally of said triangular top;

a view window formed in a front portion of said sidewall, said front portion extending between said second and third angles;

said sheltered space accessed by a slit extending through said front portion of said sidewall and sealed by a closing means; and a clamping member slidably coupled to said support pole proximate said second end for coupling said shelter to a planar member.

2. A portable shelter as claimed in claim 1, wherein said clamp member includes:

a C-shaped portion having a substantially horizontal first prong and a second prong substantially parallel to said first prong and coupled thereto by an upright member for receiving a planar member; and a compression member threadably extending through one of said first prong and said second prong to clamp said planar member between said compression member and said opposing prong.

* * * * *